United States Patent [19]

Sornes

[11] 4,149,394

[45] Apr. 17, 1979

[54] LOCK ARRANGEMENT EMPLOYING MECHANICALLY ACTING CODE CARD AND KEY CARD

[75] Inventor: Tor Sornes, Moss, Norway

[73] Assignee: Elkem-Spigerverket A/S Troiving, Moss, Norway

[21] Appl. No.: 891,390

[22] Filed: Mar. 28, 1978

[30] Foreign Application Priority Data

Apr. 6, 1977 [NO] Norway ..... 771253

[51] Int. Cl.[2] ..... E05B 71/00

[52] U.S. Cl. ..... 70/352; 70/385; 70/386; 70/387

[58] Field of Search ..... 70/350, 351, 352, 382, 70/385, 386, 387, 393, 402, 405, 409

[56] References Cited

U.S. PATENT DOCUMENTS

| | | | |
|---|---|---|---|
| 2,692,495 | 10/1954 | Verdan | 70/351 |
| 3,595,042 | 7/1971 | Sedley | 70/352 |
| 3,780,548 | 12/1973 | Anastasov | 70/352 |

*Primary Examiner*—Robert L. Wolfe

*Attorney, Agent, or Firm*—Haseltine, Lake & Waters

[57] ABSTRACT

Lock apparatus comprising a housing in which is movably supported a locking member for movement between locked and unlocked positions. The housing and locking member have aligned bores containing blocking pins supported for movement between a first position in which the locking member is movable relative to the housing and a second position in which the blocking pins block movement of the locking member relative to the housing. A plate-like key member and a plate-like code member are respectively insertable into slots provided in the housing. The bores in the housing and locking member are arranged in a predetermined pattern and the plate-like members have respective regions corresponding to the location of the bores in the pattern. The key and code members are provided with holes at the regions corresponding to the location of the bores in such an arrangement that there is one thickness of material of a card at each bore whereas at the remainder of the card outside the regions corresponding to the bores, there are two thicknesses of material. The differences in the thickness of material is employed to mechanically move the blocking pins to the first position when at each of the regions corresponding to the bores there is but a single thickness of material.

7 Claims, 6 Drawing Figures

LOCK ARRANGEMENT EMPLOYING MECHANICALLY ACTING CODE CARD AND KEY CARD

FIELD OF THE INVENTION

The present invention relates to a lock apparatus comprising a housing, a locking member, blocking pins which, by means of a substantially platelike key member are movable in bores between two positions wherein they prevent and permit, respectively, relative motion between the locking member and the housing, the combination of the lock being determined by a substantially platelike code member.

BACKGROUND

Such locks are of special interest for hotels, where it is not uncommon that the guests forget to leave the key upon departure or that the key is lost in some other way. For security reasons, it will be desirable to change the combination of the lock to a new key. Also a number of other institutions will have similar requirements.

Locks of this type are previously known for instance from U.S. Pat. Nos. 3,271,983 and 3,661,763. Here the blocking pins consist of rod magnets which are movably arranged between the key and code members. The blocking pins may be moved axially to releasing position by corresponding magnetized sections on the key and code members. Since in these locks the blocking pins may be moved only by means of magnetic forces which are relatively weak, dust and other foreign matter can reduce the movability of the blocking pins to such an extent that they can not be moved sufficiently by the magnetic sections on, for instance, the key member in order for the lock to be opened. This problem is aggravated by the fact that iron containing dust will be attracted by the magnetic blocking pins. In addition, there is the possibility of unintentional de- or re-magnetization of the key member so that it may no longer be used to open the lock. Furthermore, it is relatively costly to change the combination of the lock because the key and code members are relatively expensive to manufacture, due to the necessary magnetizing equipment. Finally these locks do not possess the desired resistance to picking.

SUMMARY OF THE INVENTION

It is an object of the present invention to provide a lock in which the above noted an deficiencies and drawbacks are overcome. This is obtained according to the invention by a lock of the type mentioned by way of introduction where the characteristic features are that the blocking pins are mechanically affected by the key and/or code member, and that the added thickness of the code and key members at the positions coinciding with the axes of the blocking pins is different from the added plate thickness of these members.

BRIEF DESCRIPTION OF THE DRAWINGS

Further features and advantageous of the invention will be apparent from the claims and from the following description of the examplifying embodiment shown on the attached drawings, wherein

DETAILED DESCRIPTION

Figure 1:
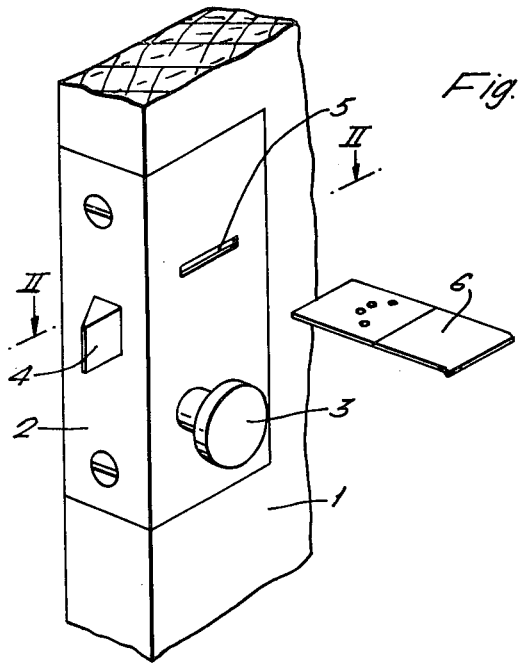
FIG. 1 shows schematically and in perspective a section of a door with a lock according to the invention and a key card.

FIG. 1 schematically shows the section of a door 1 which is equipped with a lock box 2 having a knob 3 and a latch bolt 4. Furthermore, the lock box has a slot 5 for a key card 6.

Figure 2:
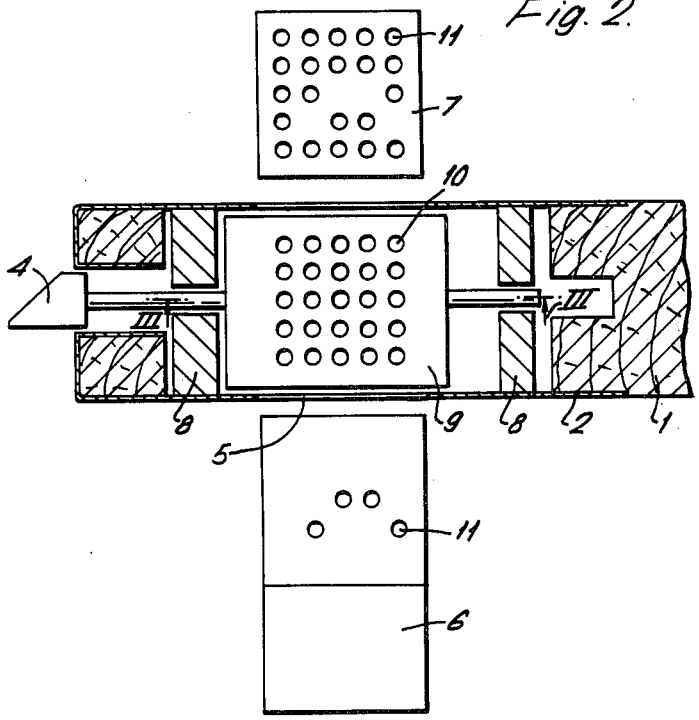
FIG. 2 is a horizontal section taken along line II—II in FIG. 1 through the door and lock with the code card and key card outside the lock.

FIG. 2 is a horizontal section taken on line II—II through the door 1 with the lock box 2. Here, also a code card 7 is shown outside the lock. In the lock box 2 a lock housing 8 is placed wherein a locking member 9 is slidably arranged. The locking member 9 is attached to the latch bolt 4. The locking member 9 is equipped with vertical, dead ended bores 10 which are arranged in a 5 ×5 matrix. The key card 6 and code card 7 are equipped with holes 11 which are placed in a matrix corresponding to the bores 10 of the locking member. It will be apparent that the holes of the key card supplement the holes of the code card so that these together form a complete matrix, i.e. the key card has holes where the code card does not have holes, and vice versa. If the key card is placed on top of the code card, the thickness of the total unit at the bores 10 is different from the combined thickness of the unit in the remaining places. Namely, at the bores, there will be a single thickness of card material whereas outside the bores there will be two superposed thicknesses of card material.

Figure 3:
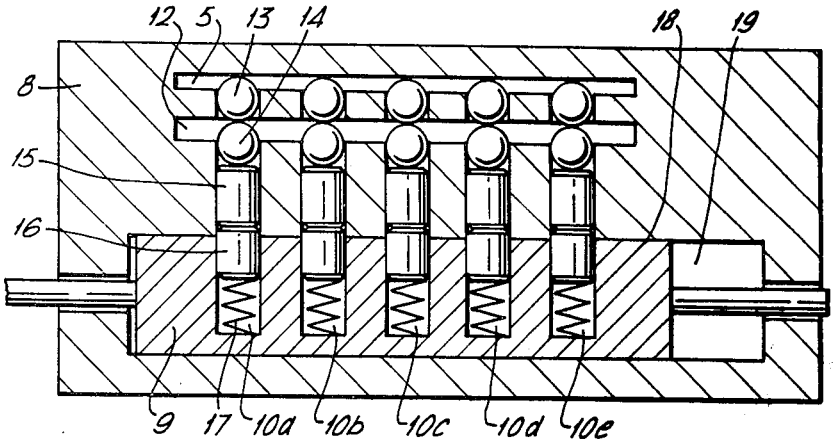
FIG. 3 shows an enlarged vertical section taken along line III—III in FIG. 2 through the lock without the code card and key card.

FIG. 3 is a vertical section through a lock housing 8 and the locking member 9. Thus, this section shows the five central bores in the locking member, the bores being designated 10*a*–10*e*. It will be apparent that these bores continue into corresponding bores in the lock housing 8. These bores end in a transverse slot 5 for the key card 6. Furthermore, the bores are intersected by a slot 12 for the code card 7.

Each of the bores contain two balls 13, 14 and two blocking pins 15, 16. The blocking pins and the balls are pressed upwards in the bore by a spring 17.

When the lock housing 8 neither contains the code card nor the key card, the lower blocking pins 16 will intersect the separating plane 18 between the top surface of the locking member 9 and the uper surface in an inner cavity 19 in the lock housing. Thus, the blocking pins 16 will prevent the locking member 9 from moving in the cavity 19.

Figure 4:
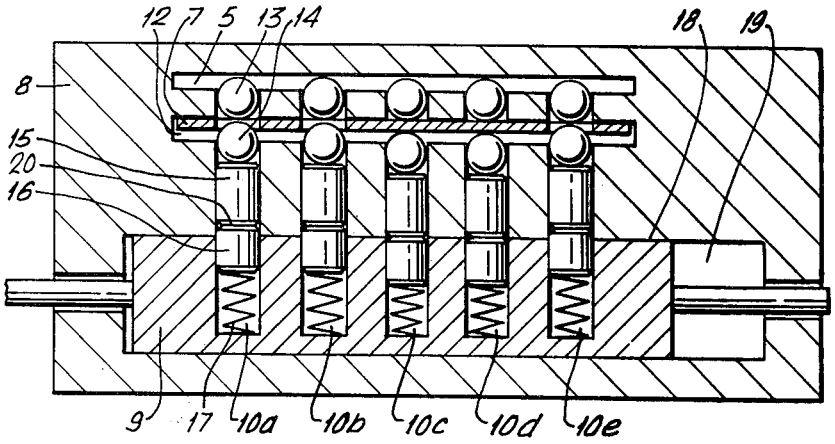
FIG. 4 shows the same section as FIG. 3 but with the code card inserted.

FIG. 4 shows the lock with a code card 7 inserted in the slot 12. The code card has holes coinciding with the bores 10*a*, 10*b* and 10*e*, and the blocking pins 16 therefore assume the same blocking position in these bores as shown in FIG. 3. However, the code card does not have holes for the bores 10*c* and 10*d*. Here, the code card presses the balls 13 and 14 apart a distance corresponding to the thichness of the code card, and this thickness is selected such that the separation plane 20 between the blocking 15 and 16 coincide with the separation plane 18 between the locking member and the lock housing.

The blocking pins in the bores 10*c* and 10*d* therefore will have no blocking influence on the locking member.

Figure 5:
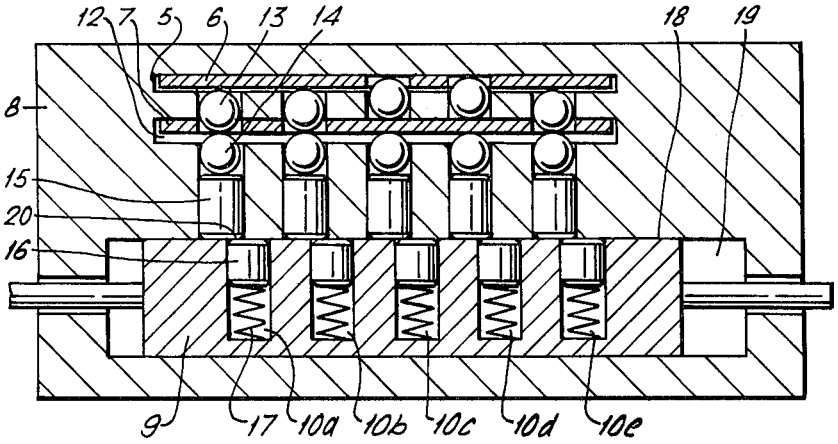
FIG. 5 shows the same section as FIG. 4 but with both code card and key card inserted.

FIG. 5 shows the condition of the lock following the insertion of a key card 6 in the slot 5. Since the key card has holes where the code card 7 does not have any, the key card will not affect the blocking pins in the bores 10*c* and 10*d*. Thus, their separating plane 20 remains coincident with the separating plane 18. However, the key card 6 does not have holes for the remaining bores 10*a*, 10*b* and 10*e*, and since the key card 6 here has the same thickness as the code card, the key card will press the balls 13, 14 and the blocking pins 15, 16 downwards sufficiently for the separating plane 20 between the blocking pins to coincide with the separating plane 18 between the locking member and the lock housing. Thereby the separating plane 20 of all the pin pairs will coincide with the separating plane 18, and the locking member 9 may be moved freely towards the right as shown in FIG. 5. The motion of the locking member may be effected in any suitable manner, and results in the withdrawal of the latch bolt 4 so that the door 1 may be opened.

It will be apparent that the slot 12 for the code card has a height wich is at least equal to twice the thickness of the code card. The code card will thus have the possibility of temporarily assuming a lower position during the insertion of the key card 6.

Figure 6:
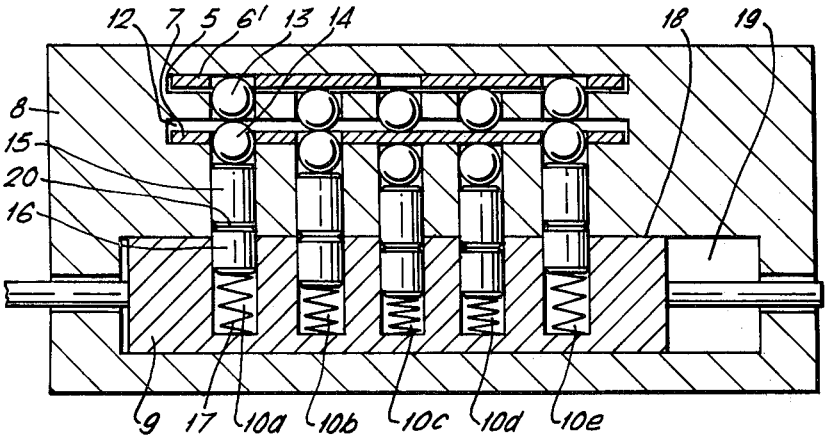
FIG. 6 shows the same section as FIG. 5 but with an incorrect key card inserted.

FIG. 6 shows what will happen to the lock in FIG. 4 if an incorrect key card 6' is inserted in the slot 5. The incorrect key card 6' has the right hole combination for the bores 10*b* and 10*c* but the remainder is wrong. However, it will be seen that for only one of the bores, namely 10*b*, will the separating plane 20 between the pins coincide with the separating plane 18. For the bore 10*c* the upper blocking pin 15 will block even though the key card has the correct combination for this position. This is a result of the blocking pins and the ball 14 in the bore 10*c* being depressed by the code card 7 which assumes a lower position because the incorrect key card 6' lacks a hole for the bore 10*d*.

It will be apparent from the preceeding examples that according to the invention a lock has been provided which in a quick and inexpensive manner may be converted to a new combination. This is simply done by exchanging the old code card with a new one. The code card may be made in a simple manner from inexpensive material like plastic, cardboard or metal. The corresponding key card may advantageously be made from the same material as the code card.

The lock may be designed so that the code card only may be introduced in its slot from the inside of the door. Only persons having access to the room will thus be able to exchange the code card and thereby invalidate the key card previously used. Access to the code card may also be blocked in other ways, for instance by means of a separate locked shutter on the inside of the door so that two keys will have to be used to gain access to the code card. Where special security requirements dictate the necessity of having two persons present for opening the door, the lock may be designed so that both the code card and the key card have to be inserted from the outside of the door.

If it is desirable that two different key cards be able to open the same lock, as in a so-called lock system, some of the blocking pins may be divided into discs having the same thickness as the key card. In this connection, one may envision a separate slot for the second key card or master key card which may act on a combination which may be built into the lock or may be set by a separate code card.

For a skilled person it will be clear that according to the invention there is provided a lock which is of a very simple design and which contains very few different parts. In the embodiment shown the blocking pins 15 and 16 are of different length, but it would be but a simple matter to change the dimensions of the lock housing in order to make these blocking pins identical. In order to further reduce the number of different parts, the blocking pins 15 and 16 may be replaced by balls. In this case it may be advantageous to make the thickness of the code and key cards equal to the ball radius.

For a skilled person it will furthermore be clear that the lock according to the invention gives a very large number of different key combinations and that this number easily may be increased by arranging more blocking pin bores. In the embodiment shown the matrix of the bores is square and symmetrical, the result being that one and the same key may be used for two different combinations by turning the key upside-down. In order to avoid such a reduction of possible combinations, it is suggested according to the invention to arrange the positions of the matrix in a non-symmetric fashion with respect to the center line of the key card. The same may be done for the code card.

I claim:

1. Lock apparatus comprising a housing, a locking member supported in said housing for movement between locked and unlocked positions, said housing and locking member having aligned bores, blocking means supported in each of said aligned bores for movement between a first position in which the locking member is movable relative to the housing and a second position in which the blocking means blocks movement of the locking member relative to the housing, a plate-like key member, a plate-like code member, said housing being provided with two slots each for respectively receiving one of said plate-like members, said bores in the housing and locking member being arranged in a pre-determined pattern, said plate-like members having respective regions corresponding to the location of said bores in said pattern, said plate-like members when inserted in said slots positioning said regions in superposed relation with one another for cooperating with said blocking means, the thickness of the card-like members in said regions being correlated in a code such that the combined thickness of said plate-like members in the superposed regions is different from the combined thickness of said plate-like members outside the superposed regions to constitute means for acting on said blocking means to mechanically move the same to said first position when said code corresponds to the pattern of the bores.

2. A lock arrangement as claimed in claim 1 wherein the combined thickness of the plate-like members in the superposed regions is half the combined thickness of the plate-like members outside said regions.

3. A lock arrangement as claimed in claim 1 wherein one of said plate-like members has holes in some of said regions and the other plate-like member has holes in the remainder of said regions such that when the cards are superposed in each of said regions there will be only one hole in one of the cards.

4. A lock arrangement as claimed in claim 1 wherein said blocking means comprises a plurality of elements in each bore, at least one element being positioned to be engaged by the key member and the code member.

5. A lock arrangement as claimed in claim 4 wherein said key member and code member engage said one element at opposite sides thereof.

6. A lock arrangement as claimed in claim 4 wherein said one element is a ball.

7. A lock arrangement as claimed in claim 4 wherein said elements of the blocking means in each bore include pin elements and ball elements, said plate-like members cooperating with the ball elements to displace the pin elements, the pin elements having a junction surface which is aligned with a mating surface between the housing and locking member in said first position of the locking means.

* * * * *